United States Patent [19]

Peterson

[11] 4,306,684

[45] Dec. 22, 1981

[54] LOW NOISE AIR NOZZLE

[75] Inventor: Robert J. Peterson, Hillsdale, N.J.

[73] Assignee: American Can Company, Greenwich, Conn.

[21] Appl. No.: 100,195

[22] Filed: Dec. 4, 1979

[51] Int. Cl.[3] ..... B65H 3/48; B05B 1/04

[52] U.S. Cl. ..... 239/597; 271/97; 271/105

[58] Field of Search ..... 271/97, 98, 105; 239/597

[56] References Cited

U.S. PATENT DOCUMENTS

| | | | |
|---|---|---|---|
| 1,498,965 | 6/1924 | Henderson | 271/98 |
| 2,406,765 | 9/1946 | Harrold | 271/98 |
| 2,848,227 | 8/1958 | Gulick | 271/98 |
| 3,398,899 | 8/1968 | Fry | 239/597 |

FOREIGN PATENT DOCUMENTS

| | | | |
|---|---|---|---|
| 1090687 | 10/1960 | Fed. Rep. of Germany | 271/98 |
| 2217755 | 6/1973 | Fed. Rep. of Germany | 271/105 |

*Primary Examiner*—Robert B. Reeves
*Assistant Examiner*—Brian Bond
*Attorney, Agent, or Firm*—Robert P. Auber; Stuart S. Bowie; William C. Hosford

[57] ABSTRACT

A low noise air nozzle system for fanning and separating stacked sheet to facilitate single sheet pick-up. The system employs nozzles which are provided with a diverging air ejection channel which terminates at the nozzle face in an orifice slit 0.025" wide.

1 Claim, 3 Drawing Figures

LOW NOISE AIR NOZZLE

BACKGROUND OF THE INVENTION

Air nozzles are employed in industry for a multitude of applications, including parts ejection, grit blow off, material transfer etc.

In a typical application, air nozzles placed adjacent to a stack of metal sheet direct a stream of high pressure air across the edges of the sheet to fan apart and separate the uppermost sheets in stack. In this way, individual sheets can be removed from the stack without the danger of accidentally removing several sheets due to the inherent tendency for stacked sheets to cling together. Since the air nozzles are only effective when they provide a pronounced thrust air pressures of 40 to 90 PSI are commonly employed.

While considerable attention has been given to nozzle design, most nozzles, even of the quiet type, have an open orifice of substantial cross sectional area so that a large volume of high pressure air is delivered by each nozzle. As the high velocity air jet impinges on and mixes with the relatively still ambient air, a turbulance is set up which produces objectionable noise. Further, the continued use of large volumes of high pressure air requires a substantial use of energy.

Accordingly, it is the primary object of this invention to provide an effective air nozzle system which generates a minimum level of sound in its operation.

It is further an object of this invention to provide a nozzle system which is effective at relatively low air pressures.

Finally, it is an object of this invention to provide a nozzle system which is relatively simple and inexpensive to manufacture.

SUMMARY OF THE INVENTION

It may be seen that the aforementioned objectives may be readily attained in a nozzle system which includes a plurality of air nozzles each having an entrance portion and an exit portion. The entrance portion is bored to provide a cylindrical air supply channel. The exit portion is machined to form a thin planar air ejection channel. The ejection channel joins the air supply channel and terminates in a slit at the nozzle face. The nozzle slits are disposed close to the stack of sheet with the slits oriented perpendicular to the plane of the sheet. Air is piped to the air supply channel of each nozzle from a pressure regulated air supply line.

It is advantageous to limit the width of the ejection channel including the terminal slit to between 0.020" and 0.030" preferably to about 0.025".

It is further advantageous to form the air ejection channel so that it is symmetrical about the flow axis with the upper and lower channel walls diverging at an angle of between 5° and 15° preferably 7° from the flow axis as the channel progresses outwardly from the junction, to the terminal slit.

It is further advantageous that the cylindrical air channel terminate in a conical configuration.

Finally, it is additionally advisable to dispose the nozzle slits about ½" from the stack of sheet.

DETAILED DESCRIPTION OF THE ILLUSTRATED EMBODIMENT

Figure 3:
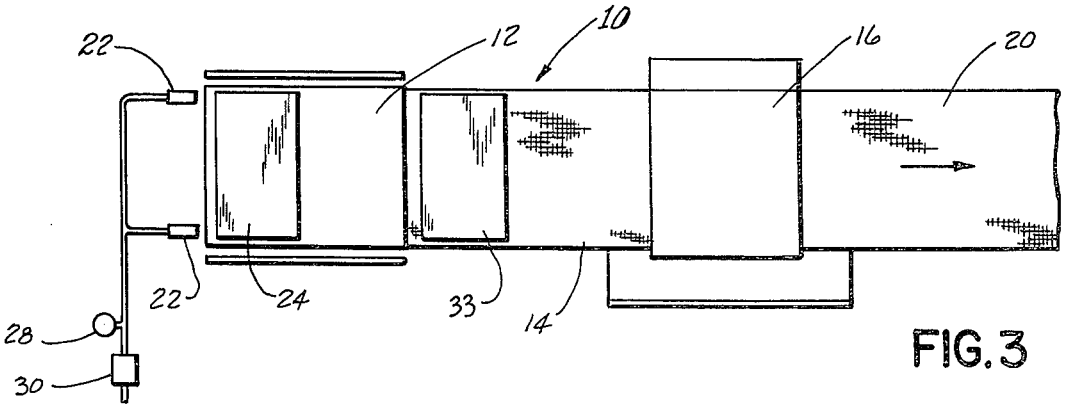
FIG. 3 is the layout of the entrance end of a sheet decorating line showing the nozzles adjacent to the sheet stack.

Turning now to FIG. 3 of the appended drawings therein illustrated is a layout of the entrance end of a metal decorating line 10 for rigid containers showing a sheet feeder 12, an infeed conveyor 14, a decorator 16 and exit conveyor 20. A pair of nozzles 22 embodying the present invention are positioned close to the edge of a feed stack 24. Air is supplied to the nozzles by means of a ⅜" supply pipe 26 equipped with a pressure gage 28 and a regulator 30. The nozzles normally operate at a pressure of between 20 and 60 psi with the preferred operating level no greater than 40 psi. At 40 psi the low noise air nozzles provide adequate air thrust to fan out and separate the uppermost sheets in the stack without introducing objectionable noise levels. Additionally it is desirable to operate at as low a pressure as is possible to conserve energy.

Figure 1:
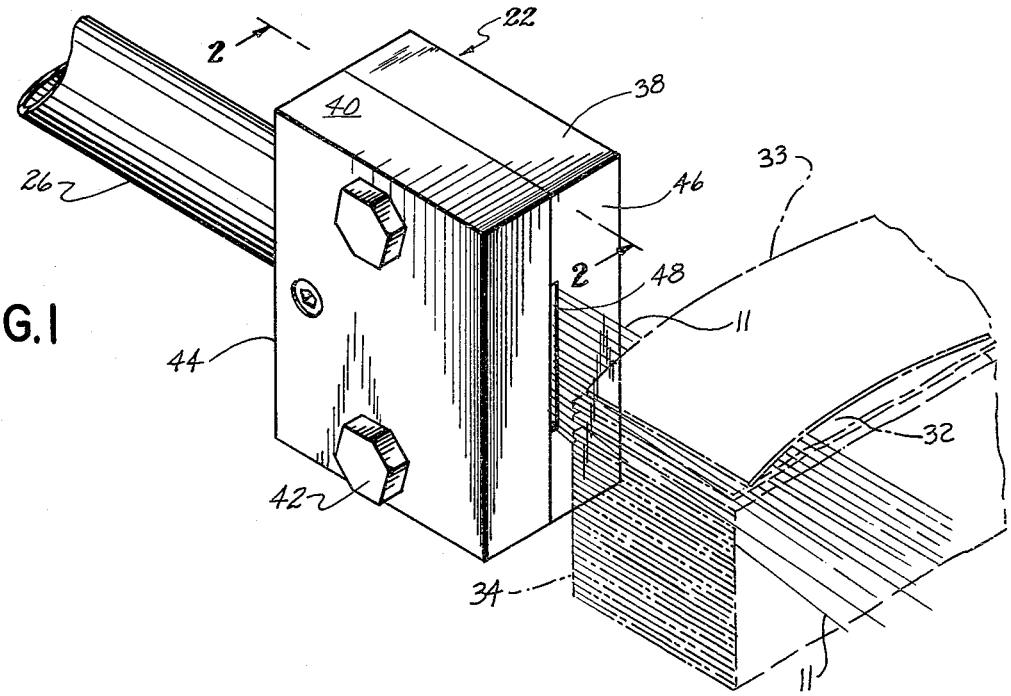
FIG. 1 is a perspective view of a nozzle assembly showing the orifice slit with the stack of sheets in phantom.
Figure 2:
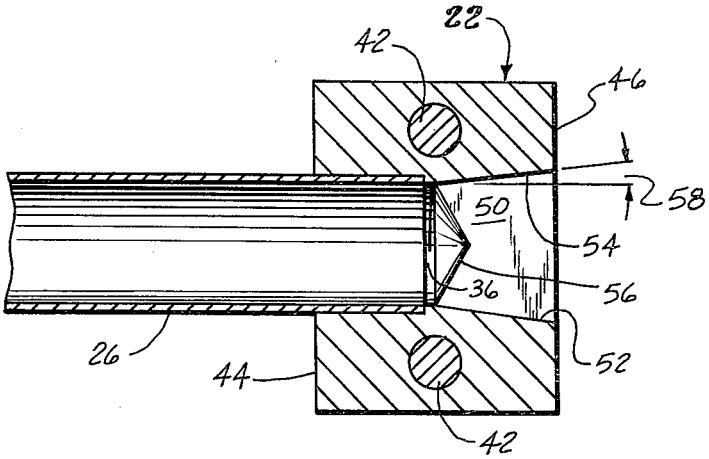
FIG. 2 is a sectional view of the side elevation as viewed in the plane 2—2 of FIG. 1.

FIG. 1 shows nozzle 22 mounted on and supported by air supply pipe 26. The stack of sheets 34 is shown in phantom, positioned in front of the nozzle with the uppermost sheets 32 fanned apart by air stream 11 for ready pick up. The entrance portion which is at the rear of the nozzle assembly is bored and tapped to receive the end of pipe 26 which is also threaded. This forms the air supply channel 36. For ease of machining, the nozzle assembly is made in two pieces 38, and 40. The nozzle assembly is 1" wide, 1¾" high and 1¼ deep has a rear 44 and a face 46. A slit 48 in the face serves as the air ejection orifice and is formed by milling a tin planar slot in the exit portion of piece 38. This slot is milled to provide a slit width of between 0.020" and 0.030". In the preferred embodiment the slit width is 0.025" and the slit height is 0.75". The slit width is critical but the slit height may be adjusted in accordance with the application. For convenience the slot is milled only in piece 38, alternatively slots may be milled in both pieces to provide the requisite slit width. The two pieces 38, and 40 are held together by bolts 42. Slot 50, which is the air ejection channel, as shown in FIG. 2 extends from a terminal slit on face 46 to the junction with the cylindrical air supply channel 36. The lower wall 52 and the wall 54 of ejection channel 50 diverge as the channel progresses from the junction outwardly to the nozzle face to form a channel symetrical about the longitudinal axis of flow. The angle of divergence from the axis of flow is shown as angle 58 which is about 5° to about 15° but for the preferred embodiment is about 7°. The angle of divergence for wall 52 is the same for wall 54. While the cylindrical air supply channel may terminate abruptly in a plane perpendicular to the axis of flow experimentation has shown that a slight reduction in noise level equal to 1–2 dba can be achieved by termination of the cylindrical channel in a cone with an included angle 56 of 120° as produced by the point of a drill bit. This conical surface is intercepted by 0.025" wide air ejection slot to form the preferred junction.

In operation a stream of air at a pressure of 40 psi as controlled by regulator 30 and as indicated by gage 28 passes through pipe 26 into air supply channel 36 through junction 56 which stabilizes the flow pattern and urges the air into the ejection channel. The gradual divergence of walls 52 and 54 results in a smooth non-turbulent flow thereby minimizing the formation of periodic vortices as the air exits from slit 48 and impacts on the stacked sheet.

The effectiveness of the nozzle was determined by two criteria. The requisite pressure to achieve fanning of the sheet and the noise level at a point 3 feet directly behind the nozzle and on the plane of the nozzle. The sound measurements were made using a General Radio Class 1 sound level meter model 1982. Laboratory tests and plant trials indicate that a sound reduction of up to 17 dba may be expected through the use of the instant low noise air nozzles.

Thus it can be seen that the instant nozzle system is effective at low air pressures, is of simple construction and generates a low level of sound in the course of its operations.

What is claimed is:

1. The low noise air nozzle for fanning stacked sheet comprising:

(a) a nozzle body with an entrance portion in the rear and an exit portion in the face; and wherein said entrance portion is bored to provide a cylindrical supply channel, said supply channel terminating within said nozzle in a conical configuration; and wherein said exit portion is milled to form a thin planar slot, said planar slot joining the base of said conical configuration with said nozzle face to form an ejection channel with a longitudinal flow axis, said ejection channel terminating in the face of said nozzle as a thin vertical planar slit about 0.025" in width; and wherein the upper and lower walls of said ejection channel diverge at an angle of 5° to 7° in progressing from said junction to said face; and (b) means joining said supply channel to provide air to said nozzle.

* * * * *